US005172457A

United States Patent [19]

Allen et al.

[11] Patent Number: 5,172,457

[45] Date of Patent: Dec. 22, 1992

[54] URN WITH TOP SEAL, BAYONET CLOSURE AND BASE ARRANGEMENT WITH SEAL

[75] Inventors: Kim Allen; Frank Allen, both of Libertyville, Ill.

[73] Assignees: F. H. Noble & Company, Mundelein, Ill.;

[21] Appl. No.: 739,843

[22] Filed: Aug. 2, 1991

[51] Int. Cl.[5] ..... A61G 17/08

[52] U.S. Cl. ..... 27/1; 248/154; 248/146

[58] Field of Search ..... 27/1, 2; 47/39, 41.14, 47/154, 146, 431, 346; 248/133, 154, 146, 346

[56] References Cited

U.S. PATENT DOCUMENTS

| | | | |
|---|---|---|---|
| 1,051,183 | 1/1913 | Allen | 248/346 |
| 2,235,617 | 3/1941 | Klinzing | 27/1 |
| 2,562,726 | 7/1951 | MacDonald et al. | 27/1 |
| 3,679,161 | 7/1972 | Husting | 248/154 |
| 3,732,602 | 5/1973 | Uigh | 27/1 |
| 4,344,645 | 8/1982 | Kirk | 248/146 |

*Primary Examiner*—Richard E. Chilcot, Jr.
*Attorney, Agent, or Firm*—Todd S. Parkhurst

[57] ABSTRACT

A funiary urn is disclosed. The urn includes a pedestal, a canister and a cap. The pedestal is attached to the canister by a bolt and a nut having an axially extended nut shank of non-circular cross-sectional shape for engaging mating apertures in the pedestal and in the canister. A gasket compressed between the inner canister surface and the nut top provides a seal inhibiting gas flow into or out of the canister at the attachment opening. When the cap is assembled to the canister, an inwardly embossed cap lip extends continuously around the cap at a locus spaced above the cap edge so as to engage the canister top edge and form a seal inhibiting gas flow. The cap is drawn tightly into its sealed position by an arrangement of detents and detent-accepting grooves.

6 Claims, 2 Drawing Sheets

URN WITH TOP SEAL, BAYONET CLOSURE AND BASE ARRANGEMENT WITH SEAL

BACKGROUND OF THE INVENTION

This invention relates generally to funiary urns or like vessels, and more particularly concerns a funiary urn which substantially inhibits or prohibits the passage of atmosphere or gas between the enclosed urn interior and the exterior environment.

The market for funiary urns has experienced increased demand for an urn which will prohibit or extensively inhibit the passage of gas out of or into the closed interior of the urn vessel. Accordingly, more or less gas-tight seals must be provided between the urn canister or vessel body and the urn top, and at any other opening in the urn vessel. These gas-tight seals should be the subject of little or no decay or degradation over an extended period of time. Nevertheless, the urn itself must be capable of being manufactured and offered for sale at an attractive commercial price.

It is accordingly an object of this invention to provide a funiary or crematory urn which is, when assembled, substantially air tight.

A related object is to provide such an urn which will remain substantially air tight for an extended period of time.

Another object is to provide a substantially air-tight urn at a commercially attractive cost.

Another object is to provide a funiary urn of the type described which can be quickly assembled by even inexperienced personnel using only a single common hand tool.

Still another object is to provide an urn of the type described which can have any one of a variety of differently styled pedestals.

Other objects and advantages of the invention will become apparent upon reading the following detailed description and upon reference to the drawings. Throughout the drawings, like reference numerals refer to like parts.

SUMMARY OF THE INVENTION

To meet these objectives, the urn of the present invention includes a pedestal, a canister and a cap. The pedestal is attached to the canister by a bolt and a nut having an axially extended nut shank of non-circular cross-sectional shape for engaging mating apertures in the pedestal and in the canister. A gasket compressed between the inner canister surface and the nut top provides a seal inhibiting gas flow into out of the canister at the attachment opening. When the cap is assembled to the canister, an inwardly embossed cap lip extends continuously around the cap at a locus spaced above the cap edge so as to engage the canister top edge and form a seal inhibiting gas passage. The cap is drawn tightly into its sealed position on the canister by an arrangement of detents and detent-accepting grooves.

DETAILED DESCRIPTION

While the invention will be described in connection with the preferred embodiment, it will be understood that it is not intended to limit the invention to this embodiment. On the contrary, it is intended to cover all alternatives, modifications and equivalents as may be included within the spirit and scope of the invention.

Figure 1:
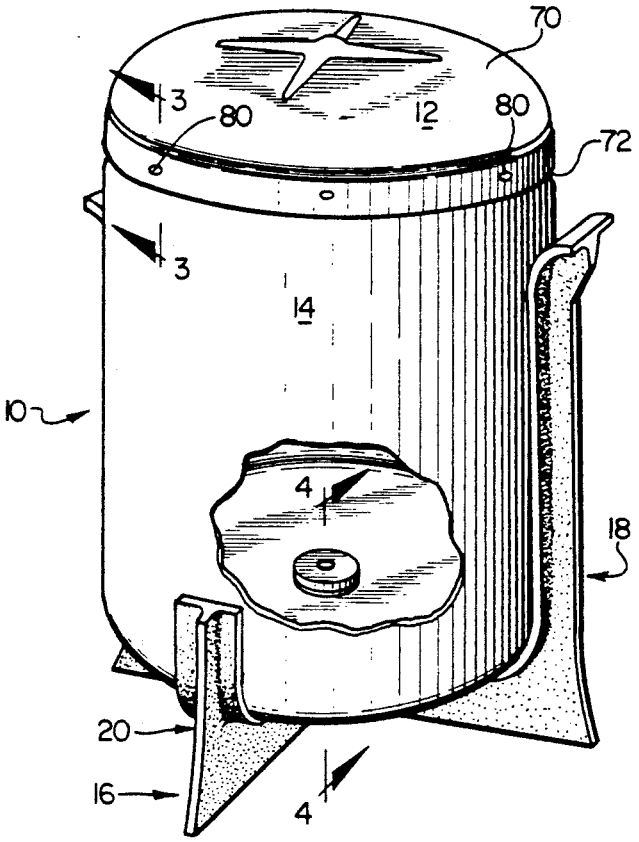
FIG. 1 is a perspective view of a funiary urn embodying the present invention, a portion of the urn canister wall being cut away to show interior urn structure.
Figure 2:
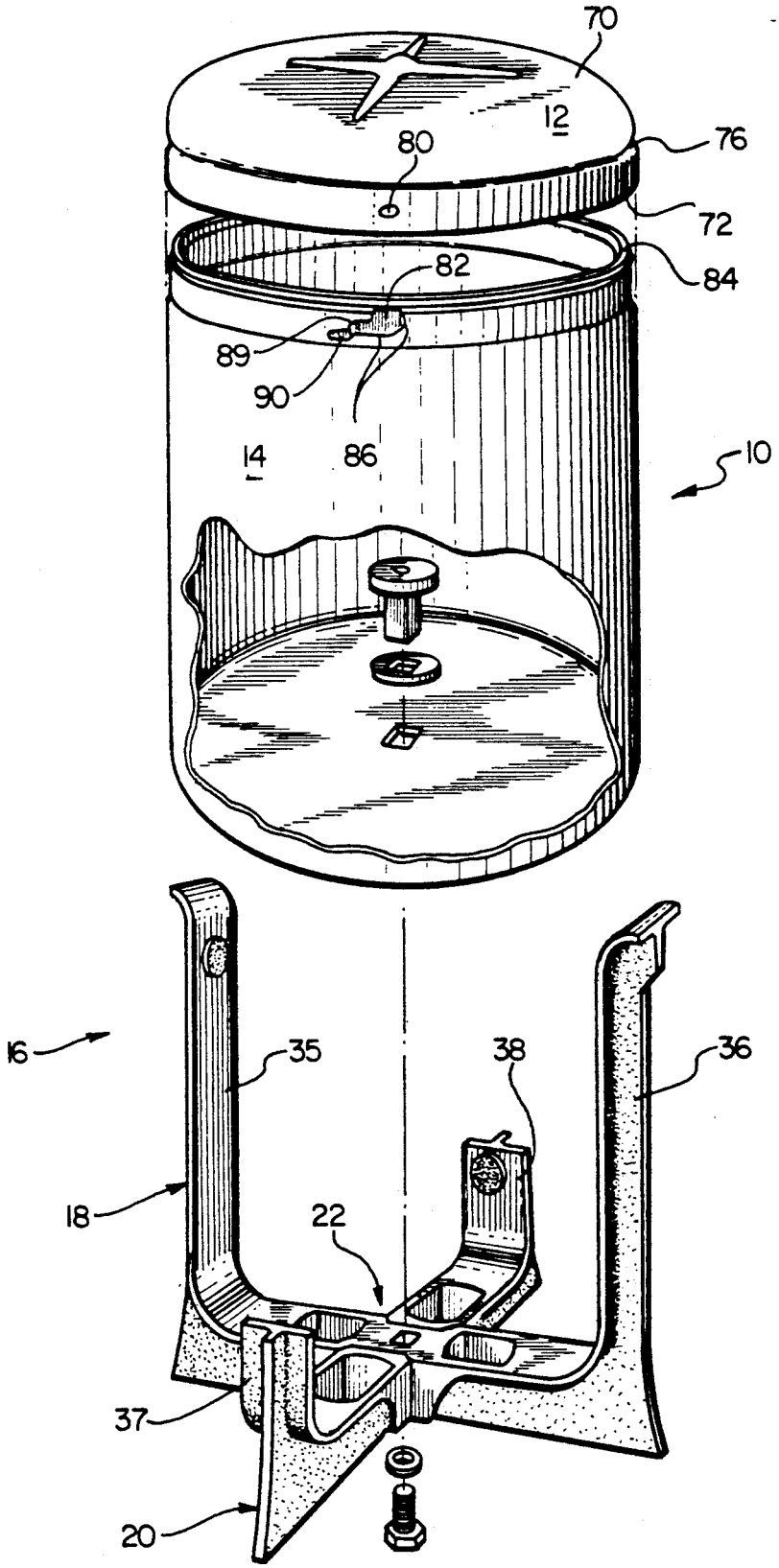
FIG. 2 is an exploded view of the urn shown in FIG. 1, a portion of the urn canister wall again being cut away to show urn parts which are to be assembled in the urn interior.

Turning first to FIGS. 1 and 2, there is shown an urn 10 embodying the present invention. In general terms, this urn includes a cap 12, a canister or body 14, and a pedestal 16. These parts can be made of brass, bronze or other metals or materials having an attractive appearance and a very long service life. The pedestal 16 can embody any one of a variety of differently styled designs, and it can include two or more supports 18, 20 which interengage at their mutual intersection 22 with an egg-crate-like-fit. That is, as more particularly suggested in FIG. 4, one U-shaped pedestal member 20 can have an upwardly-opening recess 30 into which fits a bridge or arm 32 of an opposite member 18. Correspondingly, U-shaped member 18 can be formed with a downwardly opening recess adapted to mate with the upwardly opening recess 30 of the opposite member 20. In the illustrated embodiment, the pedestal members 18, 20, each include two arms 35, 36, 37, 38 which embrace the canister 14.

Figure 4:
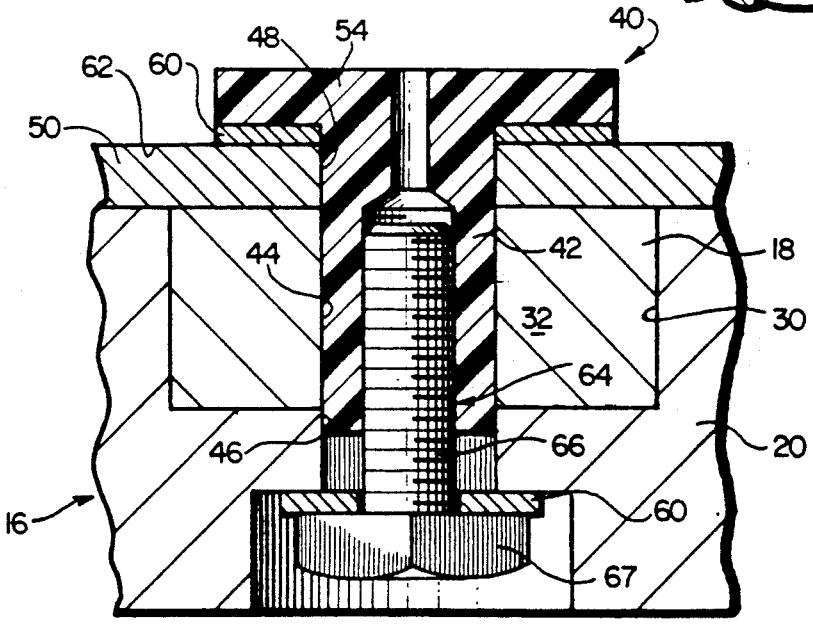
FIG. 4 is a fragmentary sectional view taken substantially in the plane of line 4—4 in FIG. 1.

In accordance with one aspect of the invention, attachment means are provided to secure the canister 14 to the pedestal 16 in such a way as to provide a seal inhibiting gas flow into or out of the canister. In the illustrated embodiment, this aspect of the invention is carried out by inserting an attachment means nut 40 (see FIG. 4) having an axially-extended shank 42 provided with female threads (not shown) and an exterior of non-circular cross-sectional shape through mating apertures 44, 46 in the member 18, 20 comprising the pedestal 16. This nut shank 42 also engages a mating non-circular aperture 48 formed in the bottom 50 of the canister 14. A nut top 54 extends axially above the nut shank 42 and radially outwardly from the shank 42, also as shown in FIG. 4. An attachment gasket 60 is compressed between the inner surface 62 of the canister bottom 60 and the nut top 54 so as to provide a seal inhibiting gas flow into or out of the canister.

A canister bolt 64 has a shank 66 provided with male threads as shown in FIG. 4, adapted to threadably engage the connector nut shank 42. A bolt head 67 directly engages a washer 68 and thus indirectly engages the pedestal 16.

Assembly of the various pedestal arms to one another, and of the pedestal 16 to the canister 14, is relatively easy. The parts are simply assembled in the array especially shown in FIGS. 2 and 4. Then the bolt 64 can be threaded and tightened into the nut 40 by the use of a single, simple nut driver hand tool in well known manner.

In carrying out another aspect of the invention, the urn cap 12 is adapted to be attached to the canister 14 with a substantially gas-tight fit which will remain effective over an extended period of time. To this end, the cap 12 can be considered to have a dome 70 and an endless circular edge 72. A cap-canister connector means 74 includes a cap lip 76 (see FIG. 3) extending radially inwardly around and in the cap at a locus or position spaced above the cap edge 72 and a canister top 84.

A plurality of cap detents 80 are formed on and extend inwardly on and in the cap 12, and a corresponding plurality of grooves 82 (See FIG. 2) are formed on and in the canister 14. These grooves 82 extend first axially downwardly from the canister top edge 84 in a first formation 86 and then arcuately around the canister in a second formation 88.

If desired, each groove 82 can be extended axially downwardly in a third formation 89 along the canister outside at a position spaced arcuately apart from the first axial downward extension 86, and then arcuately around the canister in a fourth formation 90 at a position spaced axially downward from the arcuate extension 86, so as to cause the cap lip 76 to engage the canister top 84 even more tightly, and thereby more completely inhibit gas flow past the cap lip and canister top.

The cap 12 can be attached to the canister body 14 in a simple and straightforward manner by even inexperienced personnel, and the attachment requires the use of no tools at all. The cap 12 is first positioned so that the cap detents 80 mate with the upper openings of the grooves 82. The cap 12 is then pushed axially downwardly so that the detents 80 slide over and into and through the first axially extending portions of the grooves 82, and then the cap is twisted so that the detents move into the arcuately extending portions 88 of the grooves. This action draws the cap 12 down upon the canister 14 so that the cap lip 76 tightly engages the top 84 of the canister 14 and provides a seal inhibiting gas flow into or out of the canister.

Figure 3:
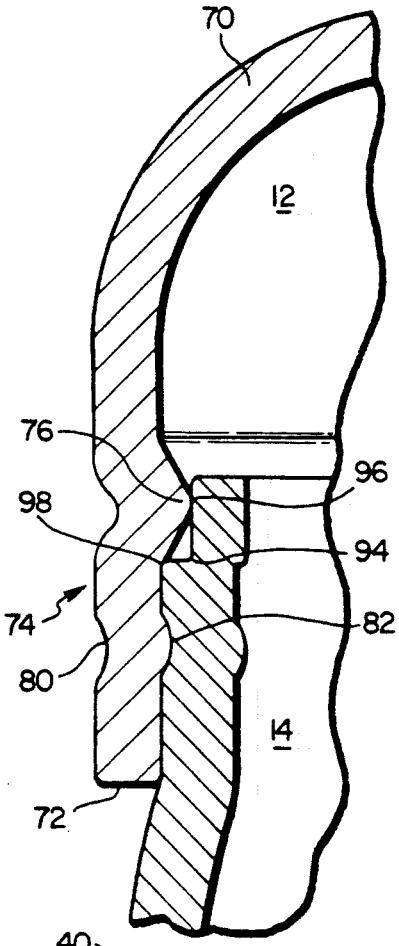
FIG. 3 is a fragmentary sectional view taken substantially in the plane of line 3—3 in FIG. 1.

As shown particularly in FIG. 3, the canister top 84 has a recessed groove 94 to provide cap lip-canister top interengagement upon two substantially continuous circular lines 96, 98 which are spaced apart from one another.

Thus, when the urn is manufactured and assembled as described here, it is substantially gas tight. Moreover, because no large rubber or other non-metallic 0-rings or other devices having relatively short useful lives are required, the urn should remain substantially air tight for an extended period of time. Nevertheless, the urn includes relatively few parts and so it can be manufactured at a commercially attractive cost.

We claim:

1. An urn or like vessel, comprising, in combination, a pedestal, a canister having an inner and an outer surface, a cap, and an attachment means for securing the canister to the pedestal, the attachment means including a nut having an axially extended nut shank of non-circular cross-sectional shape for engaging a mating aperture in the pedestal and a mating aperture in the canister, and a nut top extending both axially above the shank and radially outwardly from the shank, an attachment gasket member compressed between the inner canister surface and the nut top to provide a seal inhibiting gas flow into or out of the canister, and a connector bolt having a bolt shank adapted to threadably engage the connector nut and a bolt head adapted to engage the pedestal.

2. An urn or like vessel, comprising, in combination, a pedestal, a canister having an inner and an outer surface, a cap, an attachment means for securing the canister to the pedestal, the attachment means including a nut having an axially extended nut shank of non-circular cross-sectional shape for engaging a mating aperture in the pedestal and a mating aperture in the canister, and a nut top extending both axially above the shank and radially outwardly from the shank, an attachment gasket member compressed between the inner canister surface and the nut top to provide a seal inhibiting gas flow into or out of the canister, a connector bolt having a bolt shank adapted to threadably engage the connector nut and a bolt head adapted to engage the pedestal, and connector means for connecting the cap to the canister, the cap having a dome and an endless circular edge, the connector means including a cap lip extending radially inwardly on and in the cap at a locus spaced above the cap edge, a plurality of detents formed on and extending inwardly on and in the cap, and a corresponding plurality of grooves formed on and in the canister and extending first axially downwardly from the canister top edge and then arcuately around the canister, whereby to engage the cap detents and draw the cap down upon the canister so that the cap lip engages the top of the canister to provide a seal inhibiting gas flow into or out of the canister.

3. An urn or like vessel, comprising, in combination a pedestal, a canister, a cap, and connector means for connecting the cap to the canister, the cap having a dome and an endless circular edge, the connector means including a cap lip extending radially inwardly on and in the cap at a locus spaced above the cap edge, a plurality of detents formed on and extending inwardly on and in the cap, and a corresponding plurality of grooves formed on and in the canister and extending first axially downwardly from the cap top edge and then arcuately around the canister whereby to engage the cap detents and draw the cap down upon the canister so that the cap lip engages the top of the canister to provide a seal inhibiting gas flow into or out of the canister.

4. An urn according to claim 3 wherein said grooves extend further axially downwardly along the canister outside surface at positions spaced arcuately apart from the first axial downward extension, and then extend arcuately around the canister outside at positions spaced axially downward from the first arcuate extension, whereby to cause the cap lip to engage the top of the canister more tightly and so more completely inhibit gas flow past the cap lip and canister top.

5. An urn according to claim 3 wherein said canister top has a recessed groove to provide cap lip-canister top interengagement along two substantially continuous circular lines which are spaced axially apart from one another.

6. An urn according to claim 1 wherein said pedestal includes a plurality of arm elements adapted to interengage one another.

* * * * *